US005273371A

United States Patent [19]

Hugron

[11] Patent Number: 5,273,371

[45] Date of Patent: Dec. 28, 1993

[54] SIGNALLING POST

[76] Inventor: Denis P. Hugron, 1855, Georges, St-Hubert, Quebec, Canada, J4T 1W2

[21] Appl. No.: 908,090

[22] Filed: Jul. 6, 1992

[51] Int. Cl.[5] ..... E01F 9/00

[52] U.S. Cl. ..... 404/10

[58] Field of Search ..... 404/10, 11

[56] References Cited

FOREIGN PATENT DOCUMENTS 2013139 8/1992 World Int. Prop. O. ..... 404/10

*Primary Examiner*—William P. Neuder

*Attorney, Agent, or Firm*—Roland L. Morneau

[57] ABSTRACT

The novel signalling post is adapted to be mounted on a flexible base member. The post comprises an outer, hollow, substantially rigid, transparent polycarbonate tubular member. The polycarbonate tubular member has a memory for returning to its original shape upon impact. An inner opaque flexible plastic tubular member is mounted inside the transparent tubular member and has a diameter to fittingly slide inside the transparent tubular member. The opaque tubular member has substantially no memory. The polycarbonate tubular member has a memory which allows the flexible opaque tubular member to maintain a substantially rigid shape and to return to its original shape if slightly deformed upon excessive impact. The transparency of the outer tubular member allows the introduction of a colored or reflecting film between both tubular members for simultaneously displaying a visual signal through the transparent tubular member while the latter protects the film against damages. The novel post is particularly adapted to be mounted on a flexible base wherein the post will be tilted upon impact by the flexibility of the flexible base.

7 Claims, 2 Drawing Sheets

SIGNALLING POST

BACKGROUND OF THE INVENTION

1. Field of the Invention

The invention relates to a signalling post adapted to be mounted on a flexible base. While the post per se remains rigid when hit laterally and in particular by a vehicle, it is expected to tilt due to the flexibility of the base on which it is preferably mounted.

The post consists of a combination of an outer tubular member made of an expensive material and an inner sleeve made of a cheap material. The thickness of the outer tubular member can, accordingly, be of reduced thickness to maintain the required rigidity by the introduction of the inner sleeve which reinforces the rigidity of the outer tubular member.

It is an object of the invention to make use of the two superposed inner sleeve and tubular member for displaying a reflective material between the inner sleeve and the tubular member. Accordingly, the tubular member protects the reflecting material from objects hitting the post, from weather conditions and generally from any external destructive conditions.

The material selected for making the outer tubular member is polycarbonate. Polycarbonate, if used alone, is transparent and practically invisible as a signalling post. Colored polycarbonate is generally not available and is expensive to produce. The inner sleeve, which is opaque, is easily available in a large variety of colors. It is according to an additional object of the invention to produce a colored cheaper post.

2. Prior Art

U.S. Pat. No. 4,343,567 to R. B. Sarver is directed to a self-erecting roadway marking post which is made of two concentrically superposed tubes. The outer tube is made polyvinyl chloride which is relatively rigid but such a material is adapted to flex under relatively small lateral blows. The inner tube is made of a flexible material such as low density polyethylene. The post, according to this invention, is particularly designed to be easily and quickly replaced because it is made of a relatively fragile outer tube which has no significant memory.

Furthermore, Sarver wraps a light reflecting sheet around the outer tube at the upper end thereof. In a second embodiment, the reflective surface is positioned inside the marking tube which is provided with an opening so that the reflective surface can be made visible. Such an opening is necessitated by the fact that the marking tube is not transparent. In fact, both the inner and the outer tubes are opaque considering that the polyvinyl chloride and polyethylene are not transparent. Furthermore, the inner tube is not contemplated to reach the upper end of the outer tube and consequently, the inner tube has no use in the installation of the reflective surface inside the outer tube.

SUMMARY OF THE INVENTION

The present invention is directed to a signalling post adapted to be mounted on a flexible base member. The post comprises an outer, hollow, substantially rigid, transparent polycarbonate tubular member. The polycarbonate tubular member has a memory for returning to its original shape upon impact. An inner opaque flexible plastic tubular member is mounted inside the transparent tubular member and has a diameter to fittingly slide inside the transparent tubular member. The opaque tubular member has substantially no memory.

The polycarbonate tubular member has a memory which allows the flexible opaque tubular member to maintain a substantially rigid shape and to return to its original shape if slightly deformed upon excessive impact. The transparency of the outer tubular member allows the introduction of a colored or reflecting film between both tubular members for simultaneously displaying a visual signal through the transparent tubular member while the latter protects the film against damages.

The novel post is particularly adapted to be mounted on a flexible base wherein the post will be tilted upon impact by the flexibility of the flexible base.

DETAILED DESCRIPTION OF THE INVENTION

Figure 1:
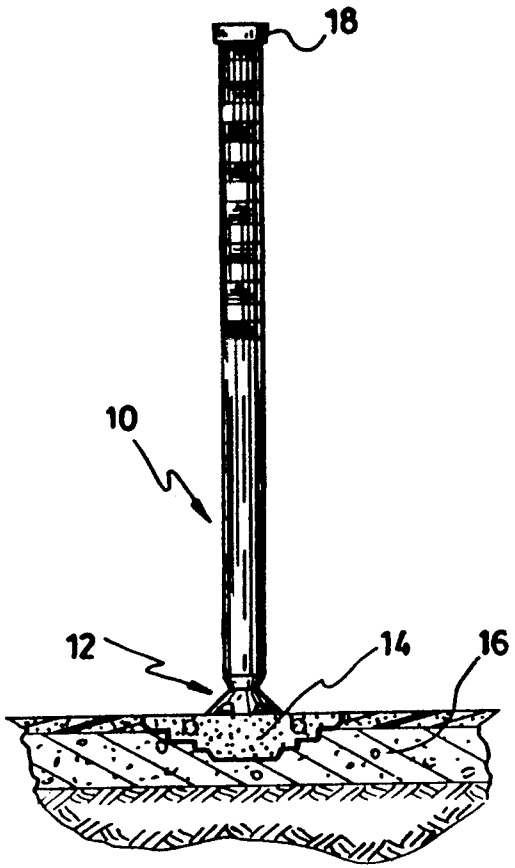
FIG. 1 is a side view of a signalling post according to the invention mounted on a flexible base secured in a pavement.

FIG. 1 illustrates the signalling post 10 mounted on a flexible base 12 secured on an anchoring member 14 inserted in a concrete base 16. The signalling post 10 is hollow and is protected by a cover 18 to prevent insertion of objects and particularly rain and snow.

Figure 2:
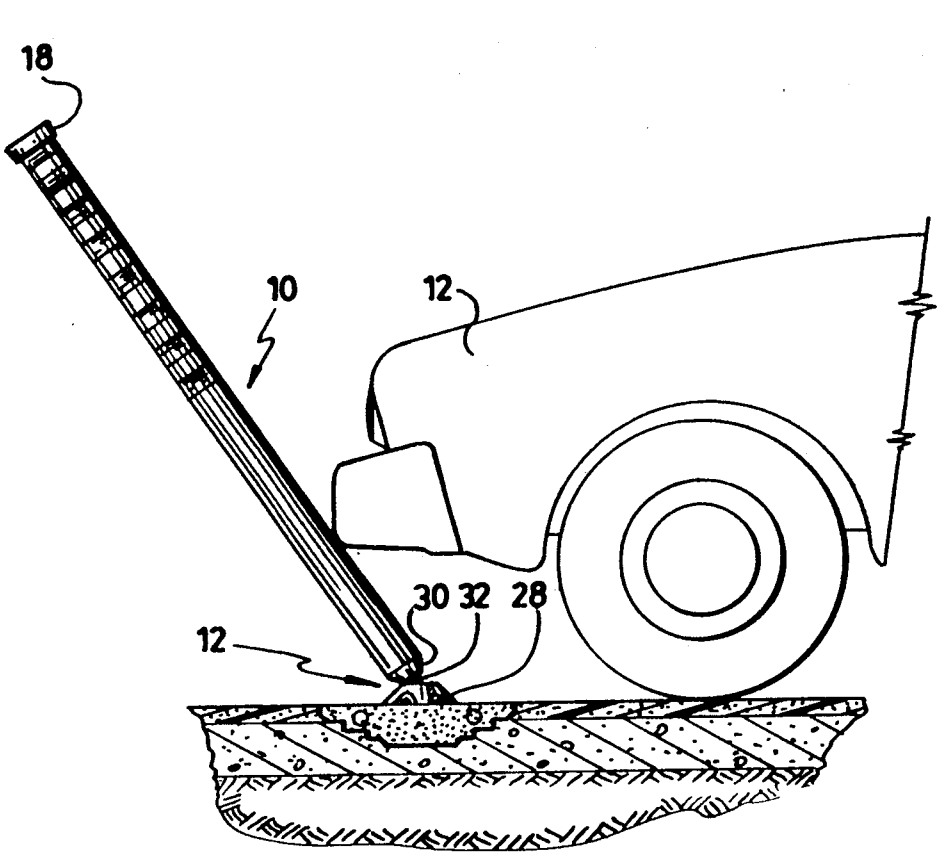
FIG. 2 is a side view of the signalling post shown in FIG. 1 being hit by a vehicle.

In FIG. 2, the signalling post 10 which is substantially rigid is hit by a vehicle 20. The signalling post 10 remains essentially straight while the flexible base 12 allows the post 10 to tilt away from the vehicle. Upon sufficient prolonged and continuous impact by the vehicle 20, the post tilts until it reaches a substantially horizontal position. The flexible base 12 is sufficiently low to allow the car to pass over the signalling post without causing unexpected damage to the undercarriage of the car.

Figure 3:
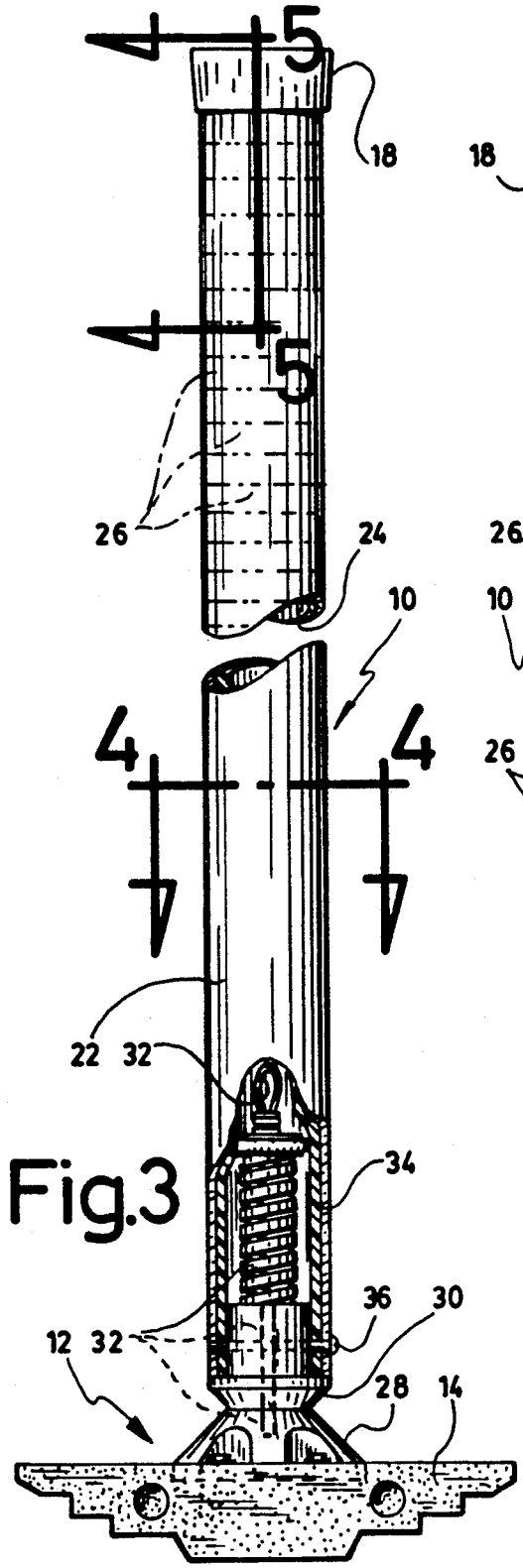
FIG. 3 is an enlarged view of the signalling post mounted on a flexible base with a portion of the signalling post cut out to show a portion of the flexible base.
Figure 5:
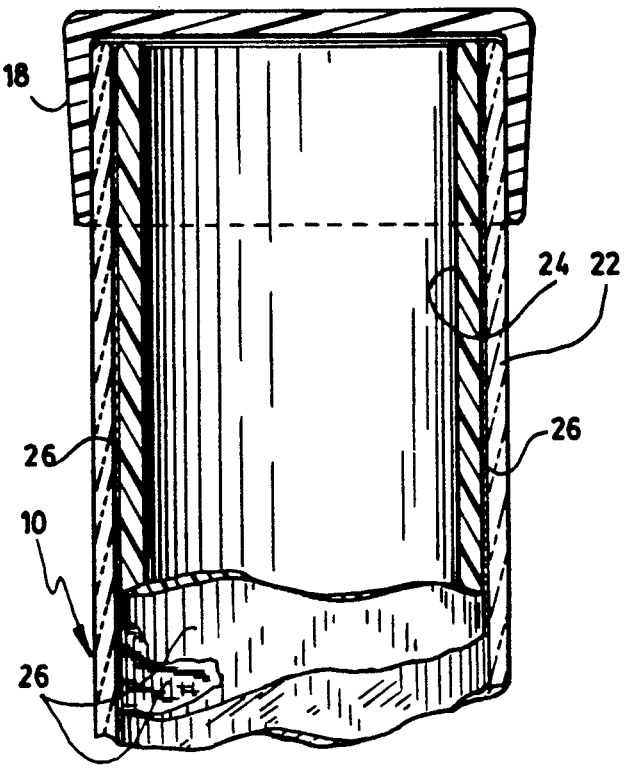
FIG. 5 is a cross-sectional view along line 5—5 of FIG. 3.
Figure 4:
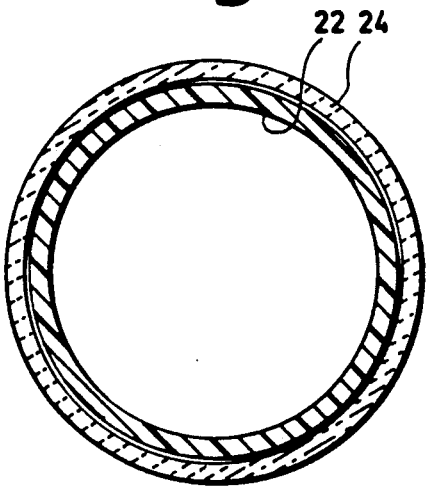
FIG. 4 is a cross-sectional view along line 4—4 of FIG. 3.

The post 10, as particularly illustrated in FIGS. 3, 4 and 5, includes an outer tubular member 22 and an inner tubular member 24. The inner member 24 is of a diameter adapted to slidingly fit in the outer tubular member wherein the outer diameter of the inner member 24 is substantially the same and preferably smaller than the inner diameter of the outer member 22.

The outer tubular member 22 is made of a material which is substantially, practically unbreakable, rigid, but which has a memory to return to its original shape upon excessive impact thereon. The material of the outer tubular member 22 is further characterized as being transparent. This material is particularly identified by a plastic called polycarbonate. Such a plastic is considered very expensive and in order to meet the resistance to impact contemplated by the present invention, the thickness of its wall will have to be substantially important and should have at least a thickness of about ¼ inch for tubular members of about 2 to 2½ inches.

The present invention makes it possible to reduce the thickness of the outer member 22 while maintaining the same contemplated characteristics by the addition of an inner sleeve 24 made of a flexible non-rigid plastic. The inner tubular member 24 being in continuous contact with the inner surface of the outer tubular member 22, compensates for the reduction of the thickness of the outer member 22 while maintaining the stiffness and the memory of a single thick tubular member completely made of polycarbonate. The inner tubular member 24 is made of plastics such as low density polyethylene, polypropylene or recycled plastics which are much cheaper than polycarbonate.

It has been found that a tubular member of polycarbonate having an outer diameter of 2½ inches and a thickness of ⅛ of an inch lined with an inner sleeve 24 having a thickness of 3/16 of an inch may be hit by a vehicle moving at a speed exceeding 100 km/hr. without substantially bending when supported by a flexible base such as illustrated and described later. Whatever amount of bending occurs at excessive impacts on the tubular member by a vehicle, the shape of the signalling post 10 returns to its original shape as soon as the impact ceases.

Another object of the present combination of materials consists in their visual characteristics. The polycarbonate is transparent and is supplied as a transparent material. A transparent material does not constitute a visibly striking material for a signalling post. Consequently, it needs to be tinted by a coloring process and such a process is expensive. On the other hand, material such as polyethylene or polypropylene are opaque material which can be colored by cheap processes and accordingly can provide a large variety of colors through the transparent polycarbonate tubular member when inserted thereinto. The color of the inner tubular member is selected according to the signal which needs to be transmitted and accordingly a large variety of selections of colors is an asset in the field of traffic signals.

A further advantage of the combination of the transparent polycarbonate outer tubular member with an inner continuous member consists in the possibility of having intermediate strips 26 of reflecting material to provide specific identification along various vertical portions of the signalling post 10. Considering that the outer tubular member 22 is transparent, the strips 26 will be clearly visible as a specific identification along the post while the remaining surface of the post not covered by the strips 26 will be colored by the presence of the inner tubular member 24. In one embodiment, the strips 26 are self-adhesive and fixed on the inner member 24.

A further advantage of the introduction of a reflecting surface behind the transparent tubular member 22 is particularly characterized by the fact that the reflective surface is protected from damages caused by impacts from vehicles or by malicious passersby. Adhesive reflecting strips are very expensive and generally very thin, i.e. of about 0.002 to 0.006 inches and accordingly need to be protected.

The post 10 is preferably mounted on a flexible base such as 12. Flexible posts of the type suitable for this invention have been described in U.S. Pat. No. 5,029,783 issued on Jul. 9, 1991 or in U.S. Pat. No. 5,090,348 issued on Feb. 25, 1992, the latter being issued to the present applicant. The flexible base 12 as shown in FIG. 3, includes a trapezoidal member 28 bolted on the anchoring member 14, the latter being designed to grip and be retained in a pavement 16 such as shown in FIG. 1. The flexible base 12 includes a stump member 30 normally resting on the trapezoidal member 28 and joined together by cables 32 secured to the trapezoidal member 28 and extending upwardly through the stump member 30 and through a coil spring 34 and secured at the upper end of the coil spring 34 to tightly maintain the stump member 30 over the trapezoidal member 28. The lower end of the signalling post 10 and in particular the lower end of the inner tubular member 24 is slidingly mounted over the upper end of the stump member 30 and fixed thereto by a bolt or cross-pin arrangement 36. Such an arrangement secures the sign post 10 on the flexible base 12. However, when the signalling post 10 is tilted, the stump member 30 tilts relative to the trapezoidal member 28 and is retained thereto by the inextensible cable 32. The coil spring 34 retains the post 10 in resilient contact with the trapezoidal member 28 and allows the post 10 to return to its vertical position as shown in FIG. 1.

I claim:

1. A signalling post adapted to be mounted on a flexible base member, said post comprising, an outer hollow, rigid, transparent polycarbonate tubular member, said outer member having a memory for returning to its original shape upon impact, an inner opaque flexible plastic tubular member mounted inside said transparent tubular member, said opaque tubular member being substantially memory free upon impact and having a diameter for fittingly sliding inside said transparent tubular member, whereby the flexible tubular member is rigidly supported by said rigid tubular member and is adapted to return to its original shape by said rigid member upon impact on said rigid member.

2. A signalling post as recited in claim 1, comprising a thin colored film located between said inner and outer tubular members for displaying a visual signal through said transparent tubular member.

3. A signalling post as recited in claim 2, wherein said film has a reflective surface on its side facing the outer tubular member.

4. A signalling post as recited in claim 1, wherein the inner tubular member is made of plastic selected from a low density polyethylene, polypropylene and recycled plastic.

5. A signalling post as recited in claim 4, wherein the outer member has a thickness of about ⅛ inch and the thickness of the inner tubular member is about 3/16 inch.

6. A signalling post as recited in claim 5, wherein the outer and inner tubular members have external diameters of about 2½ inches and 2¼ inches respectively.

7. A signalling post as recited in claim 3, wherein the film has a thickness of about 0.002 to 0.006 inch.

* * * * *